United States Patent [19]

Wafer et al.

[11] 4,220,935

[45] Sep. 2, 1980

[54] CURRENT LIMITING CIRCUIT BREAKER WITH HIGH SPEED MAGNETIC TRIP DEVICE

[75] Inventors: John A. Wafer, Beaver; William E. Beatty, Jr., S. Beaver Township, Beaver County, both of Pa.

[73] Assignee: Westinghouse Electric Corp., Pittsburgh, Pa.

[21] Appl. No.: 952,035

[22] Filed: Oct. 16, 1978

[51] Int. Cl.[2] ..... H01H 75/10; H01H 73/36

[52] U.S. Cl. ..... 335/38; 335/35; 335/174

[58] Field of Search ..... 335/35, 36, 37, 23, 335/279, 38, 174

[56] References Cited

U.S. PATENT DOCUMENTS

| | | | |
|---|---|---|---|
| 2,412,304 | 12/1946 | Staley | 335/279 |
| 3,179,767 | 4/1965 | Middendorf | 335/37 |
| 3,646,489 | 2/1972 | Hopkinson | 335/279 |

*Primary Examiner*—Harold Broome
*Attorney, Agent, or Firm*—Robert E. Converse, Jr.

[57] ABSTRACT

A molded case current limiting circuit breaker includes separable contacts, an operating mechanism releasable to effect automatic separation of the contacts, and a high speed electromagnetic trip device operable upon overcurrent conditions to release the operating mechanism and separate the contacts. The trip device includes a U-shaped pole piece disposed about a conducting path through the circuit breaker and a movable laminated armature mechanically coupled to the operating mechanism and magnetically coupled to the pole piece. The thickness of the armature is substantially greater than the thickness of the pole piece. During extreme overcurrent conditions electrodynamic force is produced upon the armature by magnetic flux in the pole piece. Upon saturation of the pole piece, force upon the armature continues to increase with increasing current due to electrodynamic force produced between the armature and the conducting path.

6 Claims, 3 Drawing Figures

CURRENT LIMITING CIRCUIT BREAKER WITH HIGH SPEED MAGNETIC TRIP DEVICE

CROSS-REFERENCE TO RELATED APPLICATIONS

The present invention is related to material disclosed in the following copending U.S. patent applications, each of which is assigned to the assignee of the present application:

Ser. No. 951,941, "Current Limiting Circuit Breaker", filed Oct. 16, 1978, by J. A. Wafer and W. V. Bratkowski; and Ser. No. 952,036, "Current Limiting Circuit Breater with Integral Magnetic Drive Device Housing and Contact Arm Stop", filed Oct. 16, 1978, by J. A. Wafer, R. H. Hill, and W. Stephenson.

BACKGROUND OF THE INVENTION

1. Field of the Invention

The invention relates generally to current limiting circuit interrupters and, more particularly, to current limiting circuit interrupters having electromagnetic tripping capability.

2. Description of the Prior Art

Circuit breakers are widely used in industrial, residential, and commercial installations to provide protection against damage due to overcurrent conditions. As the usage of electrical energy has increased, the capacity of sources supplying this electrical energy has increased correspondingly. Therefore, extremely large currents can flow through distribution circuits should a short circuit condition occur. Conventional circuit interrupters are incapable under these conditions of preventing severe damage to apparatus connected downstream from the interrupter.

Current limiting circuit interrupters were developed to provide the degree of protection necessary on circuits connected to power sources capable of supplying very large fault currents. One type of circuit interrupter provides such current limiting action by operating to achieve extremely rapid separation of the contacts during short circuit conditions. This action produces an arc voltage across the contacts which quickly approaches the system voltage, thus limiting the current flow between the contacts. Although the performance of prior art current limiting circuit interrupters of this type was adequate in certain applications, it would be desirable to provide a circuit breaker providing an even higher degree of current limiting action. Furthermore, prior art current limiting circuit interrupters were expensive to manufacture and bulky in size, thus limiting their applicability. It would therefore be desirable to provide a current limiting circuit interrupter offering increased performance in a smaller size at a more economical cost.

Under certain conditions, arc re-ignition may occur following a current limiting operation. Independent latching systems separate from the operating mechanism which maintain the contact arm in an open position are effective but expensive solutions to this problem. It would be desirable to provide a current limiting circuit interrupter not subject to arc re-ignition which would eliminate the need for an independent latching system.

SUMMARY OF THE INVENTION

In accordance with a preferred embodiment of the present invention, there is provided a current limiting circuit breaker comprising separable contacts, an operating mechanism adapted for manual operation to move the contacts between open and closed positions and being releasable to effect automatic separation of the contacts, and a high speed electromagnetic trip device operable upon overcurrent conditions to release the operating mechanism and separate the contacts. Conductor means are provided to connect the contacts to an external circuit being protected.

The electromagnetic trip device includes a U-shaped pole piece disposed about the conductor means and a movable laminated armature mechanically coupled to the operating mechanism and magnetically coupled to the pole piece. The thickness of the armature is substantially greater than the thickness of the pole piece.

During overcurrent conditions, current flow through the conductor means generates magnetic flux in the pole piece which produces electrodynamic atrractive force between the pole piece and the laminated armature. This attractive force increases with increasing current flow, up to the point at which the pole piece saturates. With prior art devices, further increases in current flow would not result in an increase in the attractive force upon the armature. The speed with which the trip device could release the operating mechanism was therefore limited by the saturation of the pole piece.

With the present invention, however, additional increases in current level beyond the saturation point of the pole piece result in an additional attractive force upon the armature produced by the electrodynamic effect of magnetic flux induced in the additional laminations of the pole piece by the current flow in the conductor means. The armature is thus attracted directly to the conductor means.

The additional attractive force upon the armature at high overload current levels results in much faster tripping action under short circuit conditions, a feature which is particularly useful in current limiting applications.

DESCRIPTION OF THE PREFERRED EMBODIMENT

Figure 1:
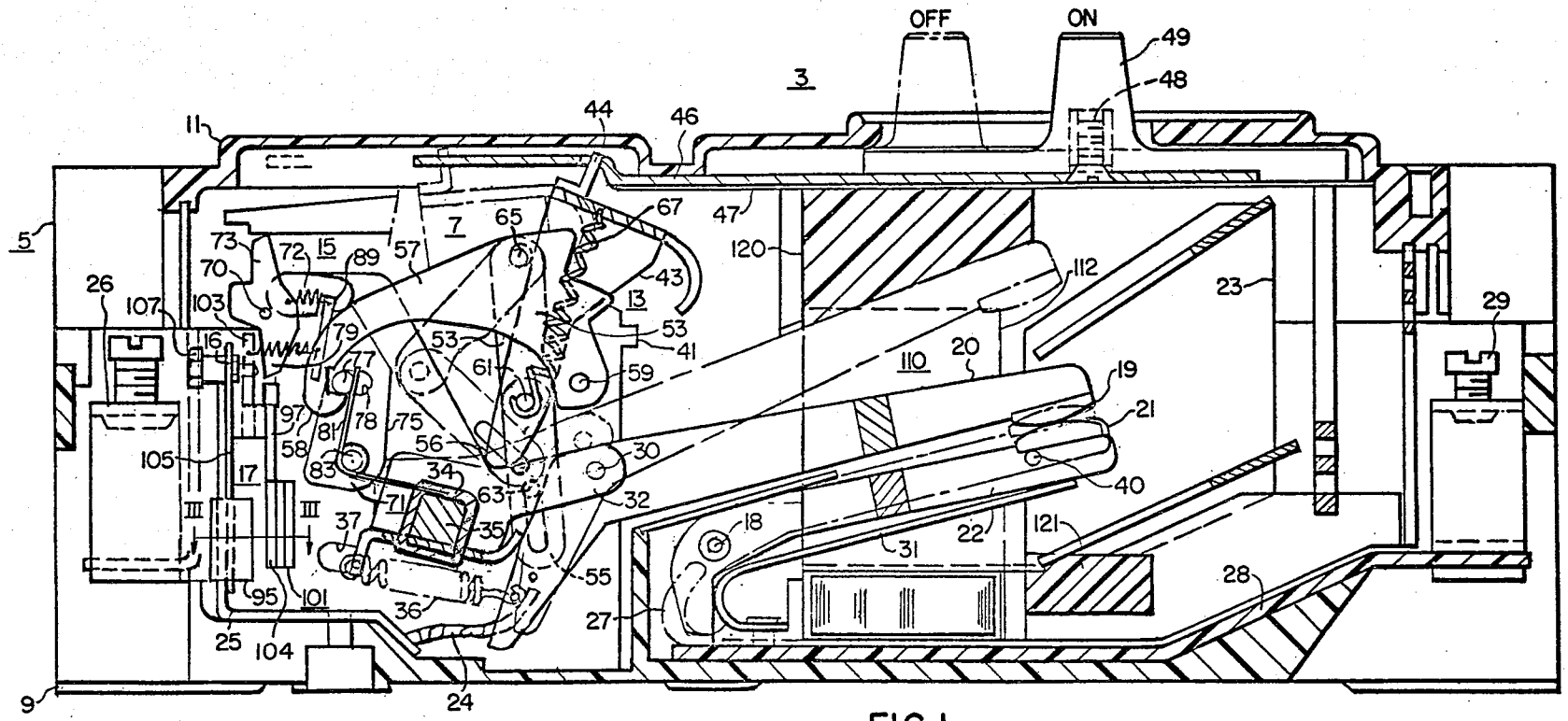
FIG. 1 is a side sectional view of a multipole current limiting circuit interrupter constructed according to the principles of the present invention, the contacts being shown in the open position.

Referring now to the drawings, in which like reference characters refer to corresponding members, FIG. 1 shows a three pole circuit breaker 3 comprising an insulating housing 5 and a high-speed circuit breaker mechanism 7 supported in the housing 5. The housing 5 comprises an insulating base 9 having a generally planar back, and an insulating front cover 11 secured to the base 9. The housing 5 comprises insulating barriers separating the housing into three adjacent side-by-side pole unit compartments in a manner well known in the art.

The circuit breaker mechanism 7 comprises a single operating mechanism 13 and a single latch mechanism 15 mounted on the center pole unit. The circuit breaker mechanism 7 also comprises separate thermal trip devices 16 and high-speed electromagnet trip devices 17 in each of the three pole units.

A pair of separable contacts 19 and 21 attached to upper and lower pivoting contact arms 20 and 22, respectively, are provided in each pole unit of the breaker. An arc extinguishing unit 23 is also provided in each pole unit. The upper contact 19 is electrically connected, through the upper contact arm 20 which is constructed of conducting material, to a shunt 24 which is in turn connected through a conducting strip 25 and the thermal and magnetic trip devices 16 and 17 to a terminal connector 26. The lower contact 21 is connected through the lower contact arm 22, also constructed of conducting material, through a shunt 27 and conducting strip 28 to a similar terminal connector 29. With the circuit breaker 3 in the closed position, an electrical circuit thus exists from the terminal 26 through the conducting strip 25, the shunt 24, the upper contact arm 20, the upper contact 19, the lower contact 21, the lower arm 22, the shunt 27, and the conducting strip 28 to the terminal connector 29.

The upper contact arm 20 is pivotally connected at the point 30 to a rotating carriage 32, which is fixedly secured to an insulating tie bar 35 by a staple 34. A tension spring 36 connected between the left end of the upper contact arm 20 and a bracket 37 attached to the carriage 32 serves to maintain the upper contact arm 20 in the position shown in FIG. 1, with respect to the carriage 32. The upper contact arm 20 and carriage 32 thus rotate as a unit with the crossbar 35 during normal current conditions through the circuit breaker 3.

The single operating mechanism 13 is described more completely in the aforementioned U.S. patent application Ser. No. 951,941, and will therefore not be described herein in great detail. The mechanism 13 is positioned in the center pole unit of the three pole circuit breaker and is supported on a pair of spaced metallic rigid supporting plates 41 that are fixedly secured to the base 9 in the center pole unit of the breaker. An inverted U-shaped operating lever 43 is pivotally supported on the spaced plates 41 with the ends of the legs of the lever 43 positioned in U-shaped notches 59 of the plates 41.

The U-shaped operating lever 43 includes a member 44 extending through a hole in a slide plate 46. The slide plate 46 is slidingly attached to the cover 11 by a support plate 47, and includes a member 48 seated in a molded handle member 49.

The upper contact arm 20 for the center pole unit is operatively connected by means of a toggle comprising an upper toggle link 53 and a lower toggle link 55 to a releasable cradle member 57 that is pivotally supported on the plates 41 by means of a pin 59. The toggle links 53 and 55 are pivotally connected by means of a knee pivot pin 61. The toggle link 53 is pivotally connected to the carriage 32 of the center pole unit by means of a pin 63 and the toggle link 55 is pivotally connected to the releasable cradle member 57 by means of a pin 65. Overcenter operating springs 67 are connected under tension between the knee pivot pin 61 and the bight portion of the operating lever 43. The lower contact arm 22 is pivotally mounted at the point 18 to the base 9.

A spring 31 urges the lower contact arm 22 in a counterclockwise direction about the pivot point 18, the counterclockwise travel of the lower contact arm 22 being limited by a stop 40. Since the clockwise force upon the upper arm 20 in the closed position is greater than the counterclockwise force on the lower arm 22, a degree of overtravel is provided from the first point of contact between the arms until the fully closed position. This allows for the effect of contact wear.

The contacts 19 and 21 are manually opened by movement of the handle 49 in a leftward direction to the position shown in FIG. 1 from the ON position to the OFF position. This movement causes the slide plate 46 to rotate the operating lever 43 in a counterclockwise direction. The rotating movement of the operating lever carries the line of action of the overcenter operating springs 67 to the left causing collapse, to the left, of the toggle linkage 53, 55 to thereby rotate the crossbar 35 in a counterclockwise direction to simultaneously move the upper contact arms 20 of the three pole units to the open position, opening the contacts of the three pole units.

The contacts are manually closed by reverse movement of the handle 49 from the OFF to the ON position, which movement moves the line of action of the overcenter springs 67 to the right in FIG. 1 to move the toggle linkage 53, 55. This movement rotates the crossbar 35 in a clockwise direction to move the upper contact arms 19 of the three pole units to the closed position.

The releasable cradle 57 is latched in the position shown in FIG. 1 by means of the latch mechanism 15. The latch mechanism 15 comprises a primary latch member 71 and an insulating trip bar 73 pivoted at the point 70. The primary latch member 71 comprises a generally U-shaped latch lever 75 and a roller member 77 movably supported for limited travel in a pair of slots in opposite legs of the lever 75. A torsion spring 81 biases the roller member 77 to one end of the slots. The primary latch member 71 is pivotally supported on the supporting plates 41 by means of a pin 83. The free end of the cradle 57 moves within a slot in the bight portion of the lever 75. The trip bar 73 is a molded insulating member pivotally supported in the support plates 41, and is provided with a secondary latch member 89 for engaging the bight portion of the latch lever 75 of the primary latch member 71 to latch the primary latch member 71 in the position seen in FIG. 1. The releasable cradle 57 is provided with a hook portion 58 serving as a primary latching surface for engaging the roller 77 to latch the cradle 57 in the position seen in FIG. 1.

The primary latch member 71 includes a bias spring 72 secured at the upper end thereof, the other end of the bias spring 72 being seated against the trip bar 73. The bias spring 72, in compression, urges the primary latch member 71 in a clockwise direction about its pivot point 83. Thus, as soon as the trip bar 73 is rotated in the counterclockwise direction raising the secondary latch 89 away from the top of the latch lever 75, the bias spring 72 will rotate the primary latch member 71 in a clockwise direction allowing the cradle 57 to be released from the roller 77. The action of the bias spring 72 is overcome during a resetting operation as will be described hereinafter.

Figure 3:
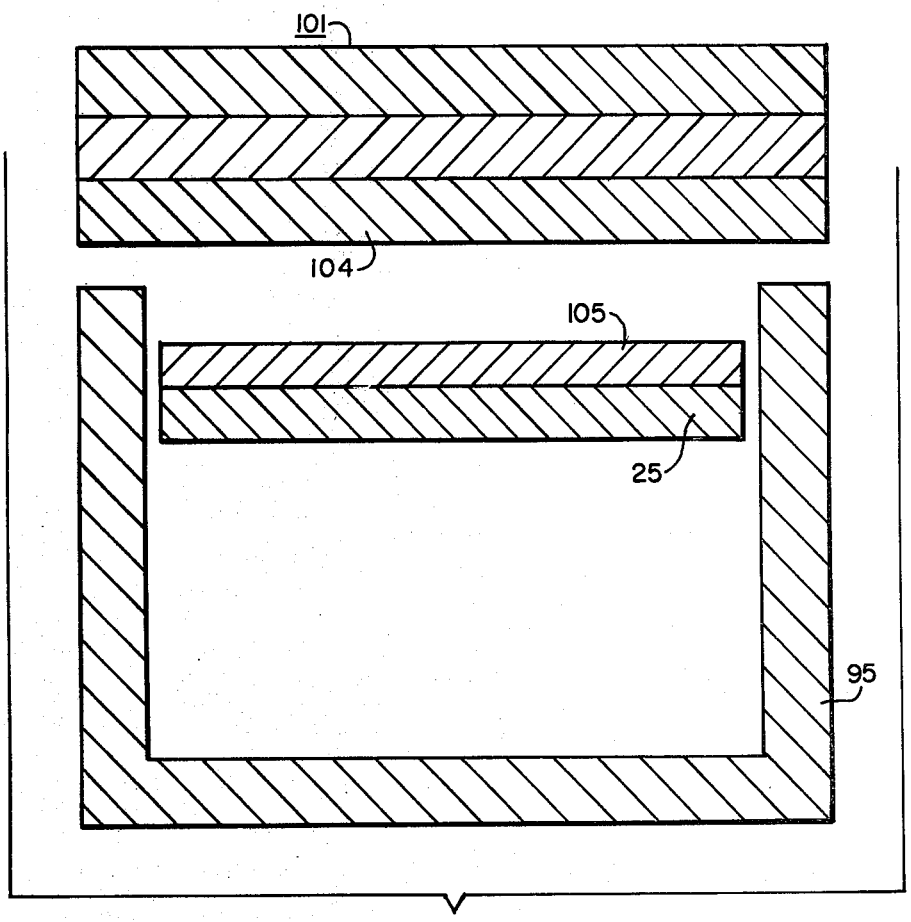
FIG. 3 is a detail top sectional view of an electromagnetic trip device constructed in accordance with the present invention taken along the line III—III of FIG. 1.

There is a separate high-speed electromagnetic trip device 17 as shown in FIG. 3 in each pole unit. Each of the electromagnetic trip devices 17 comprises a generally U-shaped pole piece 95, the legs of which extend around the conducting member 25. The conducting member 25 thus forms a single turn about the bight portion of the U-shaped pole piece 95. An armature structure 97 is pivotally supported in the housing 5 and includes a laminated magnetic clapper 101 and an actuating member 103. The thickness of the first lamination 104 is approximately equal to the thickness of the pole piece 95.

A separate thermal trip device 16 is also included in each pole unit. The thermal device 15 includes a bimetal element 105 welded to the conducting strip 25. The upper end of the bimetal element 105 includes an adjusting screw 107 threaded therein.

When the circuit breaker is in the latched position, the springs 67 operate through the toggle link 55 and pivot 65 to bias the cradle 57 in a clockwise direction about the pivot point 59. Clockwise movement of the cradle member 57 is restrained by engagement of the latching surface of the hook portion 58 under the roller 77 of the primary latch member 71, with the cradle member 57 pulling the primary latch member 71 in a clockwise direction about the pivot 83. Clockwise movement of the primary latch member 71 about the pivot 83 is restrained by engagement of the primary latch member with the secondary latch part 89 on the trip bar 73. The force of the primary latch member 71 against the secondary latch 89 of the trip bar 73 operates through the axis of the pivot of the trip bar 73 so that clockwise movement of the primary latch member 71 is restrained by the trip bar 73 without tending to move the trip bar 73 about its axis. Thus, the trip bar 73 is in a neutral or latching position, latching the primary latch member 71 and cradle member 57 in the latched position.

Upon occurrence of a high overload current above a predetermined value in any of the pole units when the circuit breaker is in the closed position, the clapper 101 is attracted toward the associated pole piece 95 whereupon the armature structure 97 pivots in a clockwise direction, to close the air gap between the pole piece 95 and clapper 101 and bridge the legs of the pole piece 95. The armature actuating member 103 is thus pivoted in a clockwise direction against the latch lever 75 of the trip bar 73. This causes rotation of the trip bar 73 in a counterclockwise direction moving the secondary latch 89 of the trip bar 73 out of engagement with the latch lever 75. The upward force of the cradle member 57 upon the roller 77 now rotates the primary latch member 71 in a clockwise direction, releasing the hook portion 58 of the cradle member 57. The force of the operating springs 67 upon the knee pin 61 is transmitted through the upper toggle link 53 to cause the cradle member 57 to rotate in a clockwise direction about the point 59. Continued rotation of the cradle member moves the upper toggle pin 65 to the right of the line of action of the operating springs 67, causing collapse of the toggle linkage 53, 55 to rotate the carriage 32 and the attached crossbar 35 in a counterclockwise direction and move all three upper contact arms 20 in a counterclockwise direction to simultaneously open the contacts of the three pole units. During this movement, the handle 49 is moved to a TRIP position between the OFF and ON positions in a well-known manner to provide a visual indication that the circuit breaker has been tripped.

Figure 2:
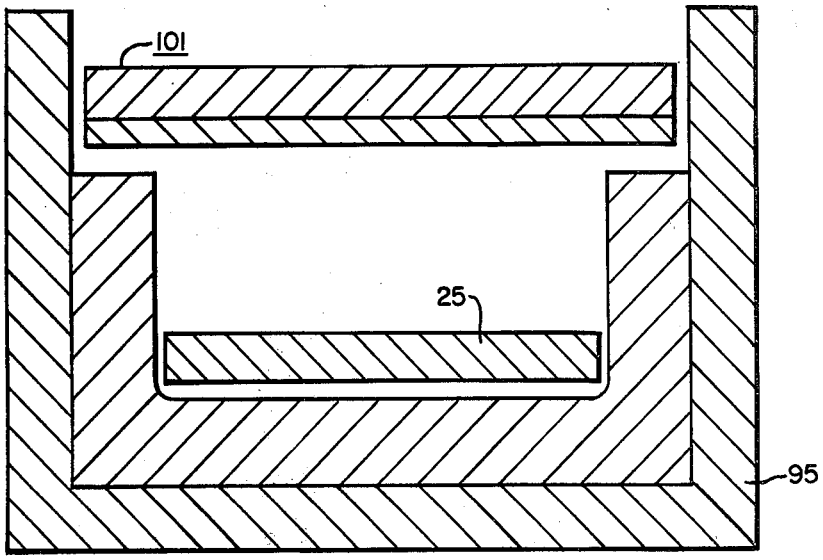
PRIOR ART FIG. 2.
FIG. 2 is a detail top sectional view of a prior art electromagnetic trip device.

For overload currents in the range of 10–16 times rated current which are traditionally considered the magnetic trip range, attractive force upon the clapper 101 increases with increasing current. Near the upper end of the magnetic trip range for prior art circuit breakers having electromagnetic trip devices as shown in FIG. 2, the pole piece 95 becomes saturated. Above this level, further increases in overload current through prior art magnetic trip devices would not yield increases in attractive force upon the clapper 101. The speed with which the electromagnetic trip device could release the operating mechanism to effect a trip operation was thus fixed, no matter how high the overload current rose above the pole piece saturation level.

The present invention provides an electromagnetic trip device which is not limited in operating speed by saturation of the pole piece. At overload current levels above the pole piece saturation level, an additional attractive force acts upon the clapper 101 due to the electrodynamic effect of magnetic flux induced in the outer laminations of the clapper by current flow through the conductor member 25. The armature is thus attracted directly to the conductor as well as to the pole piece.

Although the present embodiment incorporates a clapper having three laminations, a greater number could be satisfactorily employed. We have determined, however, that the total thickness of the clapper must be substantially greater than the total thickness of the pole piece and any core member which may be attached thereto. Preferably, the clapper is at least twice as thick as the pole piece. While it is not necessary that the laminations by electrically insulated from each other, it is important that they not be electrically bonded by soldering or brazing, but are joined by either spot welding, riveting or insulative bonding. We have determined that soldering or braze bonding results in substantial degradation of performance at high overload current levels.

Before the circuit breakers can be manually operated after an automatic tripping operation, the circuit breaker mechanism must be reset and latched. This resetting operation is effected by movement of the handle 49 from the intermediate TRIP position to the full OFF position. During this movement, the slide plate 46 acts upon the member 44 of the operating lever 43 to rotate the operating lever 43 in a counterclockwise direction about the pivot point at the notch 59 in the support plates 41. A lower extending member 45 of the operating lever 43 engages a corresponding surface 58 of the cradle member 57 to move the cradle member 57 in a counterclockwise direction about the point 59.

During this movement, the hook portion 58 of the cradle member 57 moves down in the slot in the bight portion of the latch lever 75 of the primary latch member 71 and the hook portion 58 of the cradle member 57 comes in contact with the roller 77 to move the roller 77 to the right in the slots and wipe past the roller 77. When the hook portion 58 of the cradle member 57 passes the roller 77, the spring 81 snaps the roller 77 back to the position seen in FIG. 1. As the primary latch member 71 reaches the position seen in FIG. 1, a part of the member 71 clears the hook or latch part 89 of the trip bar 73, whereupon the spring 72 biases the latch part 89 into latching engagement with the primary latch member 71 to latch the primary latch member 71 in the position seen in FIG. 1. Thereafter, upon release of the handle 49 by the operator, the springs 67 again act upon the toggle link 55 to bias the cradle member 57 in a clockwise direction to move the hook portion 58 up to engage the roller 77 in the latched position seen in FIG. 1. Thereafter, the handle 49 can be manually moved back and forth between the ON and OFF positions to close and open the contacts.

With the circuit breaker in the closed and latched position, a low current overload condition will generate heat and cause the upper end of the bimetal member 105 to flex to the right as seen in FIG. 1. The adjusting screw 107 impinges on the armature actuating member 103 of the armature structure 97. This causes counterclockwise rotation of the trip bar 73 to initiate a tripping action and achieve automatic separation of the contacts in all three pole units as hereinbefore described with regard to a magnetic trip.

As can be seen in FIG. 1, the circuit breaker also includes a slotted magnetic drive device 110. The magnetic drive device 110 includes a housing 112 having a slot 118 within which are disposed the upper and lower contact arms 20 and 22. The magnetic drive device 110 is described more completely in the aforementioned U.S. patent application Ser. No. 952,036.

A bumper member 120 is provided to limit the travel of the upper contact arm 20 during current limiting operations as will be described hereinafter. The bumper member 120 is composed of shock absorbing material such as polyurethane or butyl plastic. This type of material has a very large mechanical hysteresis loop, thus absorbing a maximum amount of energy and minimizing rebound. A similar member 121 mounted to the base 9 is provided for the lower arm 22.

Under short circuit conditions, extremely high levels of overload current flow through the circuit breaker 3. The current flow through the conductor member 28 and lower contact arm 22 generates a large amount of magnetic flux in the slotted magnetic drive device 110. This flux and the current flow through the lower contact arm 22 produces a high electrodynamic force upon the lower contact arm 22, tending to drive the arm 22 from the closed position shown in dashed lines in FIG. 4 toward the bottom of the slot 118. In addition, the current flow through the contact arms 20 and 22 in opposite directions generates a high electrodynamic repulsion force between the arms 20 and 22. This force builds up extremely rapidly upon occurrence of a short circuit condition, causing the upper contact arm 20 to pivot in a counterclockwise direction about the pin 30, acting against the tension force of the spring 36, from the closed position shown in dashed lines in FIG. 1 to the current limiting position shown in solid lines. The upper contact arm 20 is thus driven with great force into the bumper members 120, which is designed so as to minimize the amount of rebound of the upper contact arm 20. This rebound is undesirable since the established arc which has been extinguished by the arc extinguishing device 23 may restrike if the contacts 19 and 21 return in close proximity. The high-speed magnetic trip device 17 is therefore designed to operate the latch mechanism 15 to release the operating mechanism 13 before the arms 20 and 22 can reclose. As the operating mechanism 13 moves from the closed position to the tripped position, the carriage 32 rotates in a counterclockwise direction to raise the pivot point of the upper contact arm 20 before the tension spring 36 returns the upper contact arm 20 to the first position with respect to the carriage 32.

Although the high-speed electromagnetic trip device disclosed herein is particularly applicable for use in current limiting circuit breakers, it may be used in any type of circuit interrupter where extremely rapid contact separation is required. For example, replacing the electromagnetic trip unit of a commercial 150 ampere molded case circuit breaker with a high-speed device as disclosed herein resulted in a reduction of contact opening time from 5 milliseconds to 3 milliseconds.

It can be seen therefore that the present invention provides a current limiting circuit breaker having a high-speed electromagnetic trip device which produces a substantial increase in performance.

What we claim is:

1. A current limiting circuit breaker comprising:

separable contacts;

conductive means adapted to connect said contacts to an external circuit being protected;

an operating mechanism releasable to effect automatic separation of said contacts; and an electromagnetic trip device operable upon overcurrent conditions to release said operating mechanism and separate said contacts, said device comprising a U-shaped pole piece having a bight portion and two leg portions disposed about said conductive means, and a movable laminated armature mechanically coupled to said operating mechanism and magnetically coupled to said pole piece, said leg portions extending from said bight portion in a direction perpendicular to said conductive means and said armature, the width of said armature being not less than the distance between said leg portions and the thickness of said armature being substantially greater than the thickness of said pole piece whereby magnetic attractive force is produced between said pole piece and said armature which increases with increasing current flow up to the point at which said pole piece saturates, and whereby additional magnetic attractive force above said saturation point is produced between said conductive means and the laminations of said armature.

2. A current limiting circuit breaker as recited in claim 1 wherein said conductive means forms a single turn about the bight portion of said U-shaped pole piece, and said laminated armature is pivoted about an axis perpendicular to the current path through said conductive means, said armature being movable to bridge the two legs of said pole piece to form a magnetic circuit therewith.

3. A current limiting circuit breaker as recited in claim 2 comprising a pivoting contact arm supporting one of said contacts and having a movable pivot point attached to said operating mechanism, and means for producing electrodynamic force upon said arm during short circuit conditions to rapidly separate said contacts, said electromagnetic trip device being operable under short circuit conditions to release said operating mechanism and move said pivot point while said contacts are separated due to the action of said electrodynamic force producing means.

4. A current limiting circuit breaker as recited in claim 1 wherein said armature comprises at least three laminations.

5. A current limiting circuit breaker as recited in claim 4 wherein the thickness of said armature is at least twice the thickness of said pole piece.

6. A current limiting circuit breaker as recited in claim 5 wherein the thickness of the lamination closest to said pole piece is approximately equal to the thickness of said pole piece.

* * * * *